United States Patent [19]

Whetstone

[11] Patent Number: 4,884,350

[45] Date of Patent: Dec. 5, 1989

[54] CARD DISPLAYING APPARATUS

[76] Inventor: Patricia M. Whetstone, Rte. 6, Wilson Lake, Columbia City, Ind. 46725

[21] Appl. No.: 227,683

[22] Filed: Aug. 3, 1988

[51] Int. Cl.[4] ..... G09F 1/10

[52] U.S. Cl. ..... 40/124; 40/617; 40/658

[58] Field of Search ..... 40/617, 658, 124; 24/3 L, 5, 129 B, 563, 571, 570; 248/74.2, 58, 496, 497, 316.7

[56] References Cited

U.S. PATENT DOCUMENTS

| | | | |
|---|---|---|---|
| 275,601 | 4/1883 | Cutter | 40/658 |
| 1,196,332 | 8/1916 | Cabell, Jr. | 40/124.4 |
| 1,769,610 | 7/1930 | Vogel | 40/124.4 |
| 2,278,695 | 4/1942 | Fluss | 40/124 |
| 2,600,091 | 6/1952 | Becker | 24/571 |
| 2,704,302 | 3/1955 | Budd | 248/316.7 |
| 2,939,234 | 6/1960 | Hill | 40/124 |
| 3,327,419 | 6/1967 | Stanos | 40/124 |
| 3,441,032 | 4/1969 | Barrett | 24/5 |
| 3,521,332 | 7/1970 | Kramer | 248/74.2 |
| 3,797,150 | 3/1974 | Hinckley | 40/124.4 |
| 3,853,226 | 12/1974 | Hine et al. | 40/124.4 |
| 4,052,805 | 10/1977 | Potter | 40/124 |

*Primary Examiner*—Robert P. Swiatek
*Assistant Examiner*—Cary E. Stone
*Attorney, Agent, or Firm*—David L. Ahlersmeyer

[57] ABSTRACT

A card hanger for displaying greeting cards and the like in a vertically suspended manner on a wall is disclosed, wherein a wire-reinforced length of garland material includes a plurality of plastic, card-hanging clips attached thereto at selectable spaced locations along the length thereof. Each clip includes a first slot formed therein into which a card is inserted and frictionally retained by resilient card-contacting portions of the clip. The clip also includes a second keyhole-shaped slot into which the garland is received and retained. A decorative ornament having a stem portion and an ornament portion snap-fits onto the clip, whereby the ornament portion conceals the clip. The elongated support member is attachable to a wall by means of a different type clip having a slot to receive the support member and a hole for hanging on a nail or the like.

19 Claims, 1 Drawing Sheet

CARD DISPLAYING APPARATUS

BACKGROUND OF THE INVENTION

The present invention relates generally to novelty items for displaying greeting cards and the like and, more specifically, to such a device wherein cards are attached to and suspended from an elongated support member.

It has long been a common practice for an individual or family to display greeting cards received in connection with a special event or holiday, or photographs portraying such an event. This may be accomplished by simply placing the cards on a table top or in a basket, or taping the cards to a wall or door frame. In the case of a holiday, such as Christmas, properly displayed greeting cards enhance the already decorative decor and provide an opportunity to relay greetings from the cards' authors to interested viewers. So as to not detract from their beauty and content, an orderly, aesthetically pleasing presentation of the cards and photographs is desired.

Several and various card display devices are known in the prior art, including several of the type requiring that a hook member be adhesively bonded to the article being displayed, which in turn is attached to an elongate strip of cooperating mounting material. One disadvantage of this type of device is that the card or photograph is often damaged when it is attempted to remove the hook member. Also, the hook members are not ordinarily reuseable for displaying subsequent articles. In one particular variation of this type of device, the cards are simply stapled to a vertical support strip.

Another type of card display device known in the prior art involves the provision of clip members fixedly or slidably mounted on an elongate strip, whereby cards and the like may be mounted at various locations along the length of the strip. In prior art devices of this type, the provision of a fixed number of clips on the strip, whether used or not, presents a package that is not necessarily asthetically pleasing. Furthermore, in the case of clips slidable along the strip, the clips are not detachable from the strip unless removed at either end thereof.

In many of the prior art card display devices, a visible point of attachment between the card and the support member, i.e., clips, is designed with only functional aspects in mind. Given that the display is usually intended to enhance the surrounding decor, the prior art has not adequately addressed the need for an asthetically pleasing card display device. Accordingly, it is desired to provide a card hanger that nondestructively displays a desired number of cards and the like, and is capable of presenting an asthetically pleasing package.

SUMMARY OF THE INVENTION

The present invention overcomes the problems and disadvantages of the above-described prior art card display devices by providing an improved card hanger, wherein a clip having a card-receiving slot formed therein is removeably attachable to an elongated support member.

In general, the invention provides a card hanger including an elongated support member and at least one clip for attaching a card to the support member. The clip includes a slot formed therein into which an edge of the card is frictionally received for retention therein. In one aspect of the invention, the clip is selectively attachable at any position along the length of the elongated support member by means of a second slot formed in the clip, into which the support member is received. In another aspect of the invention, the two slots are formed in the clip at opposite top and bottom edges thereof, so that the card may be easily suspended from the elongated support member. In this arrangement, the clip is substantially flat and the two slot are formed in the clip such that the support member and card are retained by the clip perpendicular to the plane of the clip.

More specifically, the invention provides, in one form thereof, a card hanger including a plastic clip attachable to an elongated support member. The clip includes a pair of slots formed therein, one into which the support member is received and the other into which the card is received. The slot holding the card includes resilient card-contacting portions between which the card is inserted and retained. The slot to receive the support member is keyhole-shaped, including an opening on the edge of the clip, a hole formed through a central portion of the clip, and a converging connecting portion therebetween. The support member is retained with the hole. In another aspect of the invention, a clip-concealing decoration is attachable to the clip for decoratively concealing the clip when the card hanger is operatively assembled. In such an arrangement, the clip is formed with an open channel into which a stem portion of the decoration is received in snap-fitting engagement therewith.

An advantage of the card hanger of the present invention is that a card may be easily displayed without being damaged.

Another advantage of the card hanger of the present invention is the provision of a reuseable device to display cards.

A further advantage of the card hanger of the present invention is versatility in positioning cards along an elongated support member, whereby the cards may be selectively located along the length of the support member without experiencing sliding relative to one another.

Another advantage of the card hanger of the present invention is that cards may be hung at different angles with respect to the elongated support member, due to versatility in the manner of attaching the card to the hanging clip, and the clip to the support member.

A still further advantage of the card hanger of the present invention is that the card-hanging apparatus is decoratively concealed, thereby providing an aesthetically pleasing package.

Another advantage of the card hanger of the present invention is that the attractive outside cover of the displayed card is made visible, while the contents thereof is easily accessible for viewing.

Yet another advantage of the card hanger of the present invention is that the elongated support member may be conveniently and decoratively hung by attachment of hanging clips at selected locations along the length thereof.

The invention, in one form thereof, provides a card-hanging apparatus for displaying a card, including an elongated support member and a clip for attaching the card thereto. The clip comprises a body portion including a first slot formed therein into which the card is frictionally received for retention therein. The body portion includes an attachment portion for removeably attaching said clip to the elongated support member. In a preferred form of the invention, the attachment portion comprises second slot formed in the body portion, into which the elongated support member is received. In the preferred form of the invention, the first slot is formed in a top edge of the body portion and the second slot is formed in a bottom edge of the body portion. In another form of the invention, the card hanger is hung on a vertical support wall by means of a clip having a slot formed therein into which the elongated support member is received. The clip includes a hole through which a mounting stud attachable to the support wall is received.

The invention further provides, in one form thereof, a card hanger for displaying a card, including an elongated support member and a clip for attaching the card to the elongated support member. The clip comprises a body portion having formed therein a first slot into which the card is frictionally received for retention therein. The body portion also has a second slot formed therein into which the elongated support member is received to removeably attach the clip to the elongated support member. An ornament is attachable to the clip for decoratively concealing the clip when the card hanger is operatively assembled. In a preferred form of the invention, the ornament includes a stem portion that is removeably attached to the body portion in snap-fitting engagement within an open channel formed in the body portion of the clip.

DESCRIPTION OF THE PREFERRED EMBODIMENT

Figure 1:
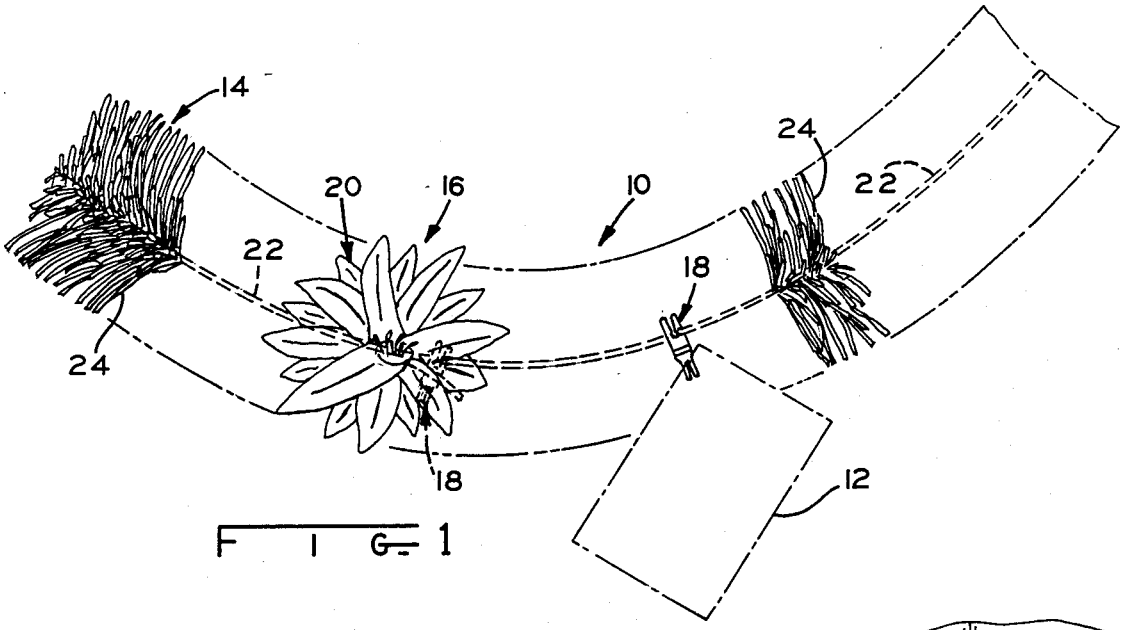
FIG. 1 is a perspective view of a card hanger in accordance with a preferred embodiment of the present invention.

In an exemplary embodiment of the invention as shown in the drawings, and in particular by referring to FIG. 1, a card hanger 10 is shown for displaying a plurality of cards 12, such as greeting cards, photographs, etc. Card hanger 10 includes an elongated support member 14 to which each card 12 is suspendedly attached by means of an ornamental clip assembly 16. Clip assembly 16 includes a clip member 18 and a detachable decorative member 20. As illustrated in FIG. 1, a card may be attached to support member 14 using clip member 18 without decorative member 20. However, this would reveal clip member 18 and, therefore, detract from the aesthetics of card hanger 10.

Elongated support member 14, in accordance with a preferred embodiment of the present invention, comprises a cut length of flexible garland-type material comprising a generally cylindrical, wire-reinforced central portion 22 extending the length of support member 14, and synthetic foilage portion 24 extending radially outwardly from central portion 22. The length of support member 14 may vary according to the particular purpose for hanger 10, and it is recognized that several smaller lengths may be joined together to create a longer support member. Pre-cut lengths of one suitable material, three inch diameter, eight-ply tinsel garland, may be obtained from Barcana, Inc. of Canada. In the preferred manner of displaying card hanger 10, support member 14 is suspended along a vertical support means, such as a wall, a stairway bannister, a fireplace mantel, a door frame, or a wall hanging.

Figure 2:
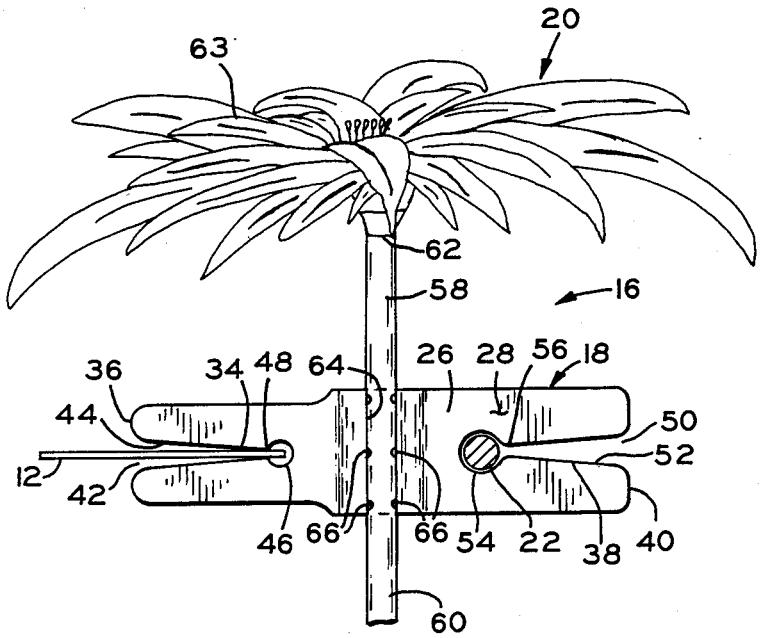
FIG. 2 is a top view of a card-hanging clip assembly of the card hanger of FIG. 1, in accordance with one embodiment of the present invention.
Figure 3:
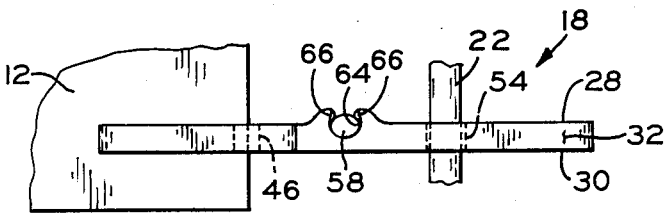
FIG. 3 is a side elevational view of the clip assembly of FIG. 2, particularly showing the clip-concealing ornament in snap-fitting engagement with the clip.

Referring now to FIGS. 2 and 3, there is shown ornamental clip assembly 16 in accordance with a preferred embodiment of the invention, including clip member 18 and decorative member 20 removably attached thereto. Clip member 18 of the disclosed embodiment is a molded piece of high-density polyethylene or any other suitable thermoplastic. Clip member 18 comprises a generally flat, rectangular body portion 26, having a top surface 28, a bottom surface 30, and a perimeter edge surface 32. Clip member 18 includes a first slot 34 formed at a bottom edge 36 of body portion 26, and a second slot 38 formed at a top edge 40 of body portion 26. Card 12 is retained within first slot 34 and central portion 22 of support member 14 is retained within second slot 38, as will be further described hereinbelow.

First slot 34 extends through body portion 26 from top surface 28 to bottom surface 30, and is generally keyhole-shaped having an opening 42 on perimeter edge 32, a converging portion 44 extending into body portion 26, and a round hole 46 communicating with converging portion 44 at a narrowing 48. Likewise, second slot 38 extends through body portion 26 and is generally keyhole-shaped having an opening 50, a converging portion 52, a round hole 54, and a narrowing 56. In the preferred embodiment shown in the drawings, converging portions 44 and 52 are defined by opposing sides having an approximate angle of 7 degrees with respect to the longitudinal axis of body portion 26. Furthermore, narrowing 48 is defined by opposing card-contacting portions spaced approximately 0.0010 inches apart. Similarly, narrowing 56 is defined by opposing corners spaced approximately 0.046 inches apart. Each of slots 34 and 38 resiliently separates in response to articles, i.e., card 12 and support member 14, being inserted therein.

Figure 5:
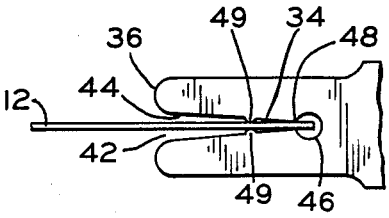
FIG. 5 is a fragmentary top view of a card hanging clip similar to that shown in FIG. 2, in accordance with an alternative embodiment of the present invention.

Referring now to FIG. 5, a portion of clip 18 is shown in accordance with an alternative embodiment of the present invention, wherein first slot 34 is provided with opposing card-contacting buttons 49. Buttons 49 are formed on the opposing slot sides constituting converging portion 44. When card 12 is introduced within slot 34, card 12 is frictionally retained therein at two locations by narrowing 48 and buttons 49.

Decorative member 20 includes a generally cylindrical, elongated stem portion 58 having a proximal end 60 and a distal end 62. Proximal end 60 is removably attached to body portion 26 by means of a snap-fit arrangement, wherein stem portion 58 is received within an open channel 64 formed in top surface 28. A plurality of resilient tangs 66 are provided on opposite sides of the opening to channel 64, whereby opposing tangs are spaced apart a distance less than the diameter of stem portion 58 so that stem portion 58 is snap-fittingly received and retained within channel 64. Decorative member 20 also includes a concealing portion comprising, for example, a radially extending artificial flower 63 attached to stem portion 58 at distal end 62. As illustrated in FIG. 2, flower 63 is spaced from body portion 26 to facilitate easy access to clip member 18.

In operation of card hanger 10 of the preferred embodiment of the invention, as illustrated in FIGS. 1–3, cards 12 are displayed at spaced intervals along support member 14 by selectively choosing the number and location of attached clip assemblies 16. As previously mentioned, a clip member 18 without a decorative member 20 may be used alone, e.g., ornamental clip assemblies 16 and undecorated clip members 18 may be alternated. Clip 18 is attached to support member 14 by means of second slot 38. Specifically, central portion 22 is inserted into hole 54 through converging portion 52, whereby narrowing 56 retains central portion 22 within hole 54. When a decorative member 20 is used, clip 18 is attached so that flower 64 faces outwardly and conceals the clip.

A card 12 is attached to clip member 18 by means of first slot 34. Specifically, an edge portion of card 12 is guidedly received into first slot 34 through converging portion 44, to a point at which card 12 is frictionally received intermediate the resilient, opposing card-contacting portions of narrowing 48, as shown in FIG. 2. While FIG. 1 shows card 12 being clipped along a folded side edge thereof, it is preferable to attach the clip to the top edge of the back page of the card so that the card may be opened to view its contents while hanging.

In the prescribed manner of attaching clip member 18 to support member 14, and card 12 to the clip member, it will be appreciated that the support member extends generally perpendicular to the plane of body portion 26. Also, the portion of the card received in first slot 34 is retained in a plane substantially perpendicular to the body portion. Accordingly, the card exhibits a natural tendency to hang in the same general plane in which the support member lies. Decorative member 20 extends outwardly from this plane to a point whereat flower 63 extends radially in a general plane parallel to the plane defined by the card and the support member. Accordingly, flower 63 is able to conceal clip member 18.

Figure 4:
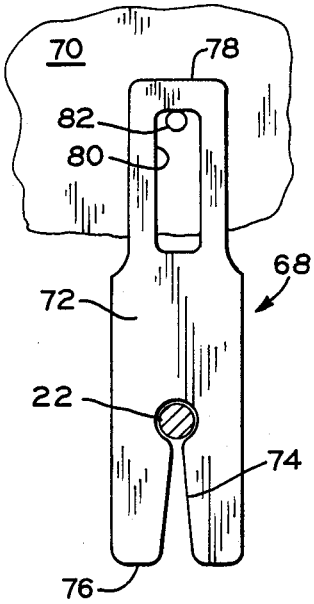
FIG. 4 is a top view of a clip used for hanging the card hanger of FIG. 1 to a vertical support wall, in accordance with the preferred embodiment of the present invention.

Referring now to FIG. 4 for an embodiment of a further aspect of the present invention, there is shown a hanging clip 68 for attaching support member 14 to a vertical support wall 70. Hanging clip 68 includes a body portion 72 having formed therein a slot 74 for receiving central portion 22 of support member 14. Clip 68 includes a bottom edge 76, which is substantially identical to top edge 40 of clip member 26, and a top edge 78. As previously described with respect to clip member 26, hanging clip 68 is attached to support member 14 by means of slot 74. Unlike clip member 26, top edge 78 of hanging clip 68 has an opening 80 formed therethrough to receive a mounting stud 82, i.e., a nail or screw, secured in support wall 70. Clip members 68 may be attached at opposite ends of support member 14 to hang card hanger 10, and at intermediate positions along the length thereof to achieve a draping effect.

It will be appreciated that the foregoing is presented by way of illustration only, and not by way of any limitation, and that various alternatives and modifications may be made to the illustrated embodiment without departing from the spirit and scope of the invention.

What is claimed is:

1. A card-hanging apparatus for displaying a card, comprising:

an elongated support member;

clip means for attaching the card to said elongated support member, said clip means comprising a plastic, substantially flat body portion including two opposite sides and an intermediate perimeter edge, said body portion having formed therein a first slot into which the card is frictionally received for retention therein and a second slot into which said elongated support member is received to removably attach said clip means to said elongated support member, each of said first and second slots having a respective opening along said perimeter edge that extends into said body portion; and decorative means for concealing said body portion when said card-hanging apparatus is operatively assembled, said body portion including retaining means, formed in one of said two opposite sides intermediate said first and second slots, for retaining said decorative means in snap-fitting engagement with said body portion, whereby attachment of the card to the elongated support member is decoratively concealed.

2. The card-hanging apparatus of claim 1 in which:

said first and second slots extend through said body portion between said two sides thereof; and said first and second slots are generally keyhole-shaped, each comprising an opening along said perimeter edge, a converging portion extending from said opening into said body portion, and a substantially round opening in said body portion in communication with said converging portion at a narrowing therebetween, the card being retained within said first slot at said narrowing and said elongated support member being retained within said round opening of said second slot.

3. The card-hanging apparatus of claim 1 in which:

said body portion includes a top edge and an opposite bottom edge, said first slot having an opening along said top edge that extends into said body portion, and said second slot having an opening along said bottom edge that extends into said body portion.

4. A card-hanging apparatus for decoratively displaying a card, comprising:

an elongated support member;

clip means for attaching the card to said elongated support member, said clip means comprising a body portion having formed therein a first slot into which the card is frictionally received for retention therein, and a second slot into which said elongated support member is received to removably attach said clip means to said elongated support member; and decorative means, attachable to said clip means, for concealing said clip means when said card hanging apparatus is operatively assembled, said clip means including channel means formed in said body portion for retaining said decorative means in snap-fitting engagement with said clip means, whereby attachment of the card to said elongated support member is decoratively concealed.

5. The card-hanging apparatus of claim 4 in which:

said decorative means includes a stem portion and said channel means comprises a channel having a top opening into which said stem portion is received, said channel having resilient tangs at opposite sides of said top opening that are spaced to snap-fittingly receive and retain said stem portion within said channel.

6. The card-hanging apparatus of claim 4 in which:

said body portion is substantially flat, including two sides and a perimeter edge, each of said first and second slots having a respective opening along said perimeter edge that extends into said body portion such that said elongated support member extends generally along a line substantially perpendicular to said body portion and the portion of the card received in said first slot is retained in a plane substantially perpendicular to said body portion; and said decorative means comprises a stem portion having a proximal end attached by said channel means to said body portion and a distal end extending outwardly from said perimeter edge substantially along the plane of said body portion, and a concealing portion attached to said distal end and extending radially therefrom in a plane substantially parallel to a plane in which said elongated support member and the card generally lie.

7. The card-hanging apparatus of claim 4, wherein said apparatus is intended to hang on a vertical support wall, and further comprising:

hanging means attachable to said elongated support member for suspending said card hanging apparatus upon the support wall, said hanging means comprising a body portion having a slot formed therein into which said elongated support member is received, and mounting means for mounting said body portion to the support wall.

8. The card-hanging apparatus of claim 4 in which:

said mounting means comprises an opening extending through said body portion of said hanging means through which a mounting stud attachable to the support wall is received.

9. The card-hanging apparatus of claim 4 in which:

said channel means is formed in one of said two opposite sides intermediate said first and second slots.

10. In a card-hanging apparatus for suspendingly displaying a card from an elongated support-member, a clip assembly for attaching the card to the elongated support member, comprising:

a generally flat body portion having two opposite sides and a perimeter edge, said perimeter edge including a top edge and a bottom edge;

a first slot formed in said body portion into which the card is frictionally received, said first slot including a first opening along said bottom edge that extends into said body portion;

a second slot formed in said body portion into which the elongated support member is received, said second slot including a second opening along said top edge that extends into said body portion; and decorative means for concealing said body portion when said card-hanging apparatus is operatively assembled, said body portion including retaining means, formed in one of said two opposite sides intermediate said first and second slots, for retaining said decorative means in snap-fitting engagement with said body portion, whereby attachment of the card to the elongated support member is decoratively concealed.

11. The clip assembly of claim 10 in which:

said decorative means includes a stem portion and said retaining means includes a channel having a top opening into which said stem portion is received.

12. The clip assembly of claim 11 in which:

said channel has resilient tangs at opposite sides of said top opening that are spaced to snap-fittingly receive and retain said stem portion within said channel.

13. The clip assembly of claim 10 in which:

said second slot is generally keyhole-shaped, comprising an opening along said perimeter edge, a converging portion extending from said opening into said body portion, and a substantially round opening in said body portion in communication with said converging portion, the elongated support member being retained within said round opening.

14. The clip assembly of claim 10 in which:

said elongated support member extends generally along a line substantially perpendicular to said body portion and the portion of the card received in said first slot is retained in a plane substantially perpendicular to said body portion.

15. The clip assembly of claim 10 in which:

said first slot includes a pair of resilient cardcontacting portions, said resilient portions being adjacently opposite one another and resiliently biased when the card is inserted therebetween.

16. The clip assembly of claim 15 in which:

said pair of resilient portions being located within said first slot and spaced inwardly from said perimeter edge.

17. The clip assembly of claim 10 in which:

said first slot converges in width from said first opening toward said pair of resilient portions.

18. The card-hanging apparatus of claim 10, wherein the apparatus is intended to hang on a vertical support wall, and further comprising:

hanging means attachable to said elongated support member for suspending said card hanging apparatus upon the support wall, said hanging means comprising a body portion having a slot formed therein into which said elongated support member is received, and mounting means for mounting said body portion to the support wall.

19. The card-hanging apparatus of claim 18 in which:

said mounting means comprises an opening extending through said body portion of said hanging means through which a mounting stud attachable to the support wall is received.

* * * * *